United States Patent [19]

Brewster

[11] Patent Number: 5,039,046

[45] Date of Patent: Aug. 13, 1991

[54] BOTTLE HOLDER

[76] Inventor: Julian Brewster, 10603 Wilcrest #49, Houston, Tex. 77099

[21] Appl. No.: 581,536

[22] Filed: Sep. 12, 1990

[51] Int. Cl.[5] ..... F16B 47/00

[52] U.S. Cl. ..... 248/206.3; 248/105; 248/302

[58] Field of Search ..... 248/107, 102, 105, 175, 248/206.3 X, 311.2, 302, 153; 211/75, 119; D6/566

[56] References Cited

U.S. PATENT DOCUMENTS

| | | | |
|---|---|---|---|
| Re. 17,735 | 7/1930 | Peterson | 248/206.3 X |
| 2,370,822 | 3/1945 | Taurman et al. | 211/75 |
| 4,598,891 | 7/1986 | Hanert | 211/119 X |
| 4,666,201 | 5/1987 | Chap | 211/119 X |
| 4,718,402 | 1/1988 | Fordyce | 248/153 X |
| 4,779,829 | 10/1988 | Rocke et al. | 248/302 X |
| 4,830,200 | 5/1989 | Zambano et al. | 211/181 |

*Primary Examiner*—Ramon O. Ramirez

[57] ABSTRACT

The present invention relates to a rack of unitary construction comprising a plurality of vertical and horizontal wire-formed members which are designed to retain baby bottles. The present invention also includes hanging means and is preferably coated in plastic for durability and corrosion resistance.

18 Claims, 1 Drawing Sheet

BOTTLE HOLDER

FIELD OF THE INVENTION

The field of the present invention is bottle cases or holders. Specifically, the present invention relates to a rack of unitary construction comprising a plurality of plastic coated wire members which are designed to retain baby bottles, jars or cans in an upright position and including hanging means.

BACKGROUND OF THE INVENTION

Plastic coated wire or metal shelving and holders are known and are used for a variety of different purposes. However, no prior art was found which was satisfactory for retaining baby bottles; particularly in a refrigerator.

Even though several different plastic powders may be applied as coatings (to metal or wire), vinyl, epoxy and nylon are the most frequently used. Vinyl and epoxy provide good corrosion and weather resistance as well as good electrical insulation. Nylon is used mainly because of its superior resistance to wear and abrasions.

Some of the processes which have been developed to apply these coatings are fluidized bed and electrostatic spraying. Fluidized bed is the most popular process. Metal or wire is preheated and then immersed in a tank of finely divided plastic powders. These powders are held in a suspended state by a rising current of air. As the powders come in contact with the heated metal, the powders fuse and adhere to the metal, forming a continuous, uniform coating which encapsulates the metal.

Electrostatic spraying works on the idea that charged materials attract each other. Powder is fed through a gun. The gun provides an electrostatic charge which is the reverse of the charge provided to the metal to be coated. As the charged particles exit the gun, they remain attracted to the metal until they are fused together as a plastic coating.

Wire or metal can be formed into virtually any shape and then heated and dipped into a tank of plastic powders until the powders fuse to the metals. This process produces a very attractive, safe and corrosive resistant finish and product.

An example of a device using this or a similar process is:

U.S. Pat. No. 4,666,201, Chap discloses a modular wrap organizer which comprises a plurality of elongated, transversely extended shelves, formed of wire members, and affixed to the sides of the supporting frames.

Volumes of baby bottles are washed, dried, filled, stored and transported by parents or caretakers of children during the first few years of infancy. Devices have been implemented to aid in washing and drying and even transporting of those bottles, but there is a very important problem which has yet to be addressed. Baby bottles with prepared formula, milk or juice must be refrigerated. However, if there is no room for these bottles in the door of the refrigerator, the bottles must be placed on the interior wire shelves of the refrigerators. The bottles may get shoved to the back and with baby bottles being tall and generally slender they tend to topple when placed on the wire shelving of a refrigerator. The narrowness of the baby bottle base, which is approximately 1 7/10" across, coupled with the gapped wires of the shelves; which wires are approximately 1/10" in diameter and include approximately 1/2" gaps between each wire, create an uneven surface for the baby bottle. The baby bottle covers approximately three separate wire gap areas, yet the baby bottle base is not quite wide enough to balance securely along the wire, hence it wobbles between two gapped areas. Also, since the majority of the available baby bottles are round or somewhat round in shape, the longitudinal direction of the wire shelves is such that the two (the wire and bottle base) never quite coordinate. This inconsistency allows the baby bottle to fall over at even the slightest movement of the refrigerator.

The few solid shelves available in most refrigerators are usually occupied with other items or cannot be positioned to accommodate the height of the baby bottles.

SUMMARY OF THE PRESENT INVENTION

The present invention relates to an article holding device designed specifically, but not limited to retaining bottles; such as baby bottles, in an upright position. A plurality of wire members are shaped to create a superior means of retaining a plurality of baby bottles.

Plastic coated wire or metal is the preferred material for the present invention because of its durability and corrosion resistance and also because it is safer when used in combination with glass bottles.

The present invention is preferably a unitary structure consisting of a plurality of horizontal and vertical members as well as hanging means. The baby bottle support of the present invention has two U-shaped supporting members to which two open oblong or rectangular shaped members are attached. For explanation purposes, the oblong shaped member will be used. The uppermost or top open oblong shaped member will be referred to as the primary oblong member and the lowermost or bottom oblong shaped member will be referred to as the secondary oblong member. The U-shaped supporting members are of such size to accommodate approximately three baby bottles lined up side by side. The bottom portion of the U-shaped members are the portion on which the bottle bases will sit while the side portions of the U-shaped members form the side members of the present invention. To secure the bottles in place, two oblong shaped members are used. The two oblong shaped members will surround the outside diameter of the bottles and will be wide enough and long enough to easily receive the bottles, yet not too wide as to allow the bottles too much movement. The two separate oblong shaped members are horizontally positioned one over the other and are positioned between the side portions of the U-shaped members, so that the side portions of the U-shaped members are centered in between what would be the end members of the oblong. This configuration allows the distal end or bottom end of the U-shaped supporting members to extend below the lowermost portion of the secondary oblong member. The two oblong members may be further secured by a plurality of vertical wire members situated perpendicular between the primary and secondary oblong members. The distal end of the u-shaped supporting members extends below the secondary open oblong member. This particular shape allows a variety of bottle sizes to fit into the present invention. Located on the rear portion of the oblong shaped members is hanging means. Several means of hanging or securing the present invention may be used. However, the preferred means for hanging is suction cups. The particular suction cups preferred include a somewhat flared area on the non-suction side. This flared area is located at the apex of the suction cup and is larger than the apex of the suction cup. The small space between the apex and the flared area is perfect for receiving a plastic coating wire member for hanging the present invention. These suction cups are known and readily available. The preferred design for accommodating the suction cups is preferably two symmetrically placed vertical wire members which originate from the back side of the secondary oblong member, extend upward, attaching to and continuing beyond the back side of the primary oblong member; bowing outward slightly to allow for insertion of flared area of suction cup, returning to original shape, immediately making a 180° turn and continuing back down vertically until finally securing to the back side of the primary oblong member. This configuration hereinafter referred to as the hanging wire. Suction cups may be placed along surface to which the present invention is to be hung and then the present invention may be placed over the flared area of the suction cups. Or, the suction cups may be attached to the present invention before hanging by inserting the flared area of the suction cups into the hanging wires and then attaching the present invention to a desired surface. Two vertical coated wire members are preferred so as to equally balance the weight of the present invention. However, a third vertical member may be added for additional securing. This third vertical member may use the same configuration as described above, including the slightly bowed area for receiving the flared area of the suction cup, but may be secured in between the back side of the primary and secondary open oblong members; which arrangement will further prevent the entire device from moving, particularly if located inside a refrigerator.

The entire device, upon completed assembly, may be coated in plastic, preferably using the fluidized bed process.

The present invention is designed specifically for accommodating baby bottles, but may be expanded to other uses. For example, attaching the present invention to a bathroom mirror for holding toiletry items, or attaching the present invention inside a shower stall for shampoo, soap and conditioner.

An object of the present invention is to provide a unique supporting member.

Another object of the present invention is to provide a more accessible means of storing baby bottles in a refrigerator.

Still another object of the present invention is to provide a solution to the problem of bottles, jars or similar items, falling over in the refrigerator.

DESCRIPTION OF THE PREFERRED EMBODIMENT

Figure 1:
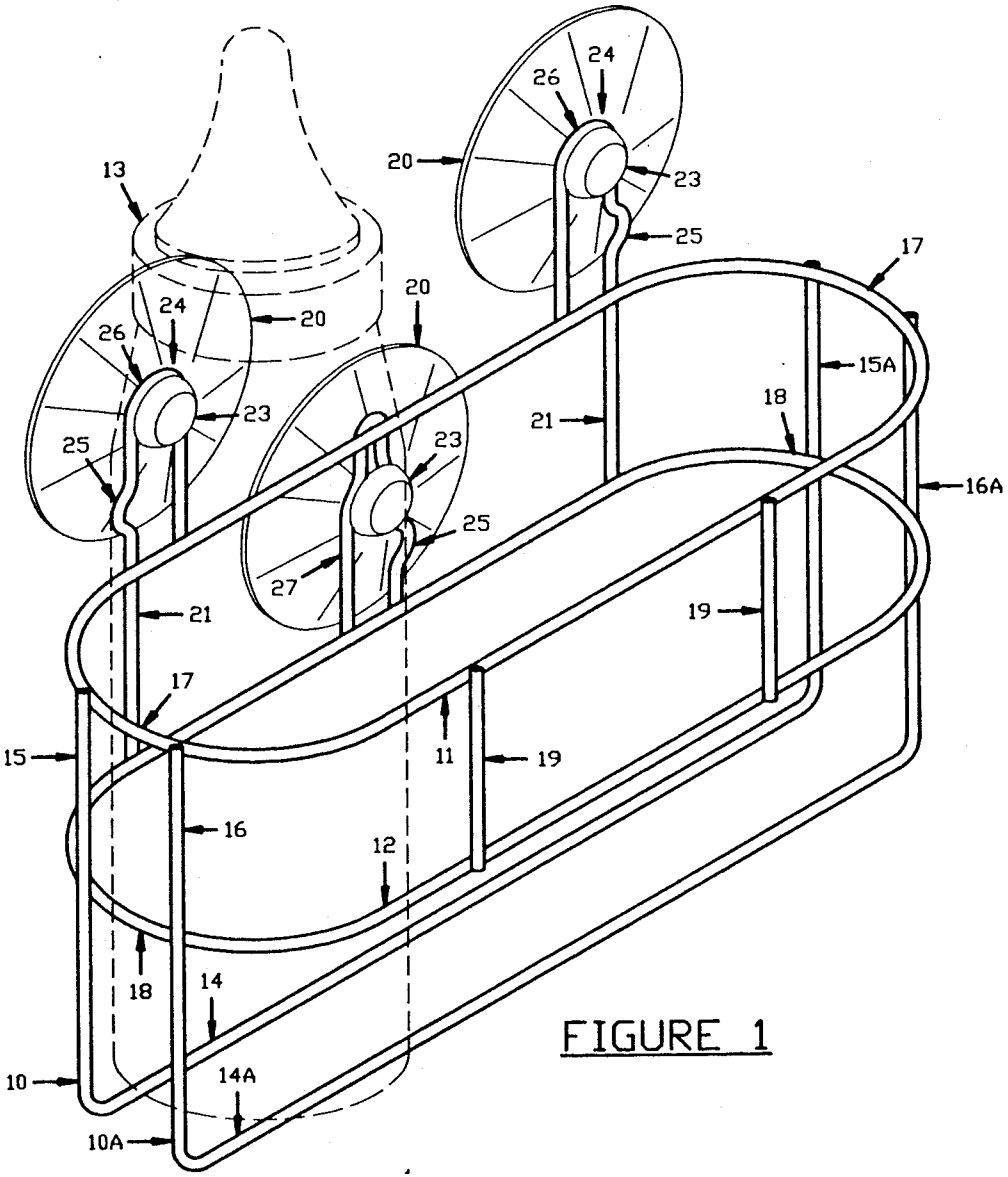
FIG. 1 is an isometric view of the present invention illustrating the primary and secondary oblong members, bottom member, vertical hanging wires and suction cups.

The drawings will allow for better understanding of the present invention which is designed to retain baby bottles in a refrigerator. The present invention is preferably made of wire formed into a unitary structure and then plastic coated for corrosion resistance, safety and durability. Now referring to FIG. 1 which is a detailed drawing of the present invention. The present invention comprises two U-shaped supporting members 10 and 10A to which two oblong or rectangular shaped members 11 and 12 are attached. For explanation purposes, the oblong members will be used. The top oblong member is referred to as the primary oblong member 11 and the bottom oblong member is referred to as the secondary oblong member 12. The U-shaped supporting members 10 and 10A are of such length which is adequate to accommodate three baby bottles 13 when they are lined up side by side. The bottom portion of the U-shaped members 14 and 14A are the portion on which the bottle bases will sit. The side portions of the U-shaped members 15, 15A, 16 and 16A form the side members of the present invention. Two oblong members 11 and 12 are used to act as the body of the present invention and secure the bottles 13 in place. Each of the oblong members 11 and 12 are of such length so that they adequately surround the bottles 13, allowing for easy insertion and removal of bottles, but not allowing too much movement. The two separate oblong members 11 and 12 are horizontally positioned one over the other. The two oblong members 11 and 12 are positioned between the two side portions of the U-shaped members 15, 15A, 16 and 16A so that the side portions of the U-shaped members 15, 15A, 16 and 16A are centered in between what would be the end members 17 and 18 of the oblong. The two oblong members 11 and 12 may be affixed to the two side portions of the U-shaped members 15, 15A, 16 and 16A by soldering means. The distal or bottom end of the U-shaped supporting member 10 and 10A are designed to extend below the secondary oblong member 12. The two oblong members 11 and 12 may be further secured by a plurality of vertical wire members 19 positioned perpendicular between the primary oblong member 11 and the secondary oblong member 12.

Located at the rear portion of the present invention is hanging means. Suction cups 20 used in combination with conformed hanging wires 21 are the preferred hanging means. The particular suction cups 20 preferred include flared area 23 molded onto the apex of the suction cup 20. This particular design includes a small space or "neck" 24 in between the apex and the flared area 23. The neck 24 will accommodate the conformed hanging wires 21 and hold the present invention securely. The conformed hanging wires 21 are preferably two symmetrically placed vertical wire members which originate from the back side of the secondary oblong member 12, extend upward, attaching to and continuing beyond the back side of the primary oblong member 11; bowing outward slightly 25 to accommodate flared area 23 of suction cups 20, returning to original shape, immediately making a 180o° turn 26 and continuing back down vertically until finally securing to the back side of the primary oblong member 11.

Two vertical conformed hanging wires 21 are preferred so as to equally balance the weight of the present invention. However, a third vertical conformed hanging wire 27 may be added for additional securing. This third vertical conformed hanging wire 27 may use the same configuration as described above, including the slightly bowed area 25 for receiving the flared area 23 of the suction cup 20, but may be secured in between the back side of the primary oblong member 11 and the back side of the secondary oblong member 12.

From the foregoing description, it will be observed that numerous variations and modifications may be effected without departing from the true spirit and scope of the novel concepts of the invention. It is to be understood that no limitation with respect to the specific apparatus illustrated herein is intended or should be inferred. It is, of course, intended to cover by the appended claims all such modifications as fall within the scope of the claims.

I claim:

1. An apparatus comprising:
a first U-shaped member;
a second U-shaped member arranged in parallel to said first U-shaped member;
a primary oblong member having a first open central area, said first and second U-shaped members being fixed at one end to said primary oblong member, said first and second U-shaped members being fixed at another end to said primary oblong member;
a secondary oblong member arranged in parallel with said primary oblong member, said secondary oblong member having a shape corresponding to said primary oblong member, said secondary oblong member having a second open central area of similar size as that of said first open central area of said primary oblong member;
hanger means connected to said primary oblong member and secondary oblong members, said hanger means for affixing said apparatus to an exterior surface; and
a vertical strut connected to said primary oblong member and to said secondary oblong member.

2. The apparatus of claim 1, each of said first and second U-shaped members comprising:
a horizontal portion extending parallel to and across said first open central area;
a first vertical portion extending from said horizontal portion so as to connect with one side of one of said primary and secondary oblong members; and
a second vertical portion extending from another end of said horizontal portion so as to connect to an opposite side of one of said primary and secondary oblong members.

3. The apparatus of claim 2, said horizontal portion positioned below said primary and secondary oblong members.

4. The apparatus of claim 1, each of said primary and secondary oblong members comprising:
a forward portion;
a rearward portion parallel to said forward portion;
a first semi-circular portion connected to one of said forward portion and said rearward portion; and
a second semi-circular portion connected to a second end of each of said forward portion and said rearward portion.

5. The apparatus of claim 1, said secondary oblong member being positioned below said primary oblong member.

6. The apparatus of claim 1, said first U-shaped member, said second U-shaped member, said primary oblong member, and said secondary oblong member being formed of a rigid wire material.

7. The apparatus of claim 6, said rigid wire material being a plastic coated wire.

8. An apparatus comprising:
a first U-shaped member;
a second U-shaped member arranged in parallel to said first U-shaped member;
a primary oblong member having an open central area, said first and second U-shaped members being fixed at one end to said primary oblong member, said first and second U-shaped members being fixed at another end to said primary oblong member;
a secondary oblong member arranged in parallel with said primary oblong member, said secondary oblong member having a shape corresponding to said primary oblong member, said secondary oblong member having a central area of similar size as that of said primary oblong member; and
hanger means connected to said primary oblong member and secondary oblong members, said hanger means for affixing said apparatus to an exterior surface, said hanger means comprising a first suction cup interconnected to one of said primary and secondary oblong members.

9. The apparatus of claim 8, said first suction cup comprising:
a suction surface;
a non-suction surface on an opposite side of said suction surface; and
a flared area formed at an apex of said non-suction surface, said flared area defining a receiving space between said flared area and said non-suction surface.

10. The apparatus of claim 9, said hanger means comprising:
a wire member connected at one end to one of said primary and secondary oblong members, said wire member engaging said receiving space of said flared area of said first suction cup.

11. The apparatus of claim 10, said wire member comprising:
a first vertical portion fastened at one end to said secondary oblong member.
a curved portion extending from said first vertical portion so as to engage said receiving space of said first suction cup; and
a second vertical portion connected to said curved portion and extending so as to connect to said primary oblong member.

12. The apparatus of claim 11, said first vertical portion having a bowed area, said bowed area having a sufficient size so as to allow the passage of said flared area between said first vertical portion and said second vertical portion.

13. The apparatus of claim 8, said hanger means further comprising:
a second suction cup interconnected to one of said primary and secondary oblong members, said second suction cup being distal from and co-planar with said first suction cup.

14. The apparatus of claim 13, said first and second suction cups being positioned a similar distance from said primary oblong member.

15. The apparatus of claim 14, said hanger means further comprising:
a third suction cup interconnected to said secondary oblong member, said third suction cup being intermediate said first and second suction cups, said third suction cup positioned between said primary and secondary oblong members said third suction cup being co-planar with said first and second suction cup.

16. The apparatus of claim 10, said wire member being a plastic coated wire.

17. An apparatus for holding baby bottles comprising:

a first U-shaped member;

a second U-shaped member arranged in parallel with said first U-shaped member, said first U-shaped member being separated from said second U-shaped member by a distance less than the diameter of said baby bottles;

a primary oblong member having an open central area, said first and second U-shaped members being connected to said primary oblong member so as to extend downwardly therefrom;

a secondary oblong member arranged in parallel with said primary oblong member, said secondary oblong member having a central area of similar size as said primary oblong member;

a first suction cup interconnected to one of said primary and secondary oblong members, said suction cup having a suction surface facing away from said primary oblong member; and a second suction cup interconnected to one of said primary and secondary oblong members, said second suction cup being distal from and co-planar with said first suction cup.

18. The apparatus of claim 17, said first U-shaped member, said second U-shaped member, said primary oblong member, and said secondary oblong member being comprised of a plastic coated rigid wire.

* * * * *